US009617960B2

(12) United States Patent
Saito

(10) Patent No.: US 9,617,960 B2
(45) Date of Patent: Apr. 11, 2017

(54) FUEL SUPPLY APPARATUS FOR INTERNAL COMBUSTION ENGINE

(75) Inventor: Kenichi Saito, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 225 days.

(21) Appl. No.: 13/988,858

(22) PCT Filed: Dec. 7, 2011

(86) PCT No.: PCT/IB2011/002947
§ 371 (c)(1),
(2), (4) Date: May 22, 2013

(87) PCT Pub. No.: WO2012/076962
PCT Pub. Date: Jun. 14, 2012

(65) Prior Publication Data

US 2013/0247874 A1 Sep. 26, 2013

(30) Foreign Application Priority Data

Dec. 8, 2010 (JP) ..... 2010-273672

(51) Int. Cl.
*F02M 51/00* (2006.01)
*F02D 41/38* (2006.01)

(52) U.S. Cl.
CPC ..... *F02M 51/00* (2013.01); *F02D 41/3854* (2013.01); *F02D 2200/0602* (2013.01); *F02D 2250/02* (2013.01)

(58) Field of Classification Search
CPC . F02M 51/00; F02D 41/3854; F02D 2250/02; F02D 2200/0602
USPC ..... 123/446, 431, 443, 445
See application file for complete search history.

(56) References Cited

U.S. PATENT DOCUMENTS 4,982,331 A * 1/1991 Miyazaki ..... 701/102
5,699,772 A * 12/1997 Yonekawa et al. ..... 123/497
5,875,743 A * 3/1999 Dickey ..... 123/25 C
6,138,638 A * 10/2000 Morikawa ..... 123/295
6,799,558 B2 * 10/2004 Gmelin et al. ..... 123/431
(Continued)

FOREIGN PATENT DOCUMENTS

CN 101087938 A 12/2007
DE 102006000016 A1 7/2006
(Continued)

*Primary Examiner* — Stephen K Cronin
*Assistant Examiner* — Susan E Scharpf
(74) *Attorney, Agent, or Firm* — Oliff PLC

(57) ABSTRACT

A fuel supply apparatus for an internal combustion engine includes: a feed pump capable of feeding a fuel of the internal combustion engine; a high pressure fuel pump that pressurizes the fuel fed from the feed pump; and a second injector that supplies the pressurized high-pressure fuel to the internal combustion engine selectively. An ECU of the fuel supply apparatus includes: a pulsation width detection unit that detects a pulsation width in a pressure of the fuel fed from the feed pump to the high pressure fuel pump; and a feeding condition determination unit that determines that a condition variation causing fuel vapor to form in the fuel fed to the high pressure fuel pump has occurred when the pulsation width detected by the pulsation width detection unit falls rapidly to a preset threshold variation width.

11 Claims, 4 Drawing Sheets

(56) References Cited

U.S. PATENT DOCUMENTS

| | | | | |
|---|---|---|---|---|
| 7,013,872 | B2 * | 3/2006 | Yamazaki et al. | 123/431 |
| 7,178,506 | B2 * | 2/2007 | Kojima et al. | 123/431 |
| 7,350,510 | B2 * | 4/2008 | Tomatsuri | F02D 41/003 123/514 |
| 7,438,051 | B2 * | 10/2008 | Wachtendorf | F02D 41/2464 123/446 |
| 2007/0000478 | A1 * | 1/2007 | Sadakane et al. | 123/431 |
| 2008/0072880 | A1 * | 3/2008 | Wachtendorf | F02D 41/2464 123/495 |
| 2009/0177367 | A1 * | 7/2009 | Toyohara et al. | 701/103 |
| 2010/0006072 | A1 * | 1/2010 | Tashima et al. | 123/511 |
| 2011/0106393 | A1 * | 5/2011 | Pursifull | F02D 33/003 701/101 |
| 2011/0162622 | A1 * | 7/2011 | Kojima | F02D 41/062 123/457 |
| 2012/0194142 | A1 | 8/2012 | Abe et al. | |

FOREIGN PATENT DOCUMENTS

| | | |
|---|---|---|
| JP | A-63-306274 | 12/1988 |
| JP | A-8-193551 | 7/1996 |
| JP | A-2001-165013 | 6/2001 |
| JP | A-2005-76568 | 3/2005 |
| JP | A-2006-200423 | 8/2006 |
| JP | A-2007-303372 | 11/2007 |
| JP | A-2008-157029 | 7/2008 |
| JP | A-2010-71224 | 4/2010 |
| WO | WO 2011/018843 A1 | 2/2011 |

* cited by examiner

FUEL SUPPLY APPARATUS FOR INTERNAL COMBUSTION ENGINE

BACKGROUND OF THE INVENTION

1. Field of the Invention

The invention relates to a fuel supply apparatus for an internal combustion engine, and more particularly to a fuel supply apparatus for an internal combustion engine that suppresses the generation of fuel vapor when fuel is pressurized by a high pressure fuel pump and supplied to the internal combustion engine through an injection valve.

2. Description of Related Art

In an internal combustion engine installed in a vehicle such as an automobile, a lean burn system in which an easily ignited, rich air-fuel mixture is formed only in the vicinity of a spark plug in a spark ignition type internal combustion engine, a fuel cut technique in which a fuel supply is stopped temporarily during deceleration or the like, and an idling stop technique in which the engine is stopped when the vehicle is stationary may be employed with the aim of improving a fuel efficiency and an exhaust gas purification performance. Further, a dual injection system in which a fuel injection valve for performing a port injection (to be referred to hereafter as a port injection valve) and a fuel injection valve for performing an in-cylinder injection (to be referred to hereafter as an in-cylinder injection valve) are used together may be employed to respond to more advanced requirements including an increase in output. In this type of internal combustion engine, a fuel supply apparatus that pressurizes fuel supplied from a low pressure fuel pump to a high pressure using a high pressure fuel pump and then supplies the pressurized fuel to the in-cylinder injection valve is typically provided in order to execute an in-cylinder injection, and it is therefore necessary to suppress fuel vapor lock in which fuel vapor is generated such that the fuel cannot be pressurized by the high pressure fuel pump.

An internal combustion engine that executes a port injection is also provided with a fuel supply apparatus that supplies pressurized fuel to the port injection valve from a fuel pump, and it is likewise necessary with this type of fuel supply apparatus to suppress fuel vapor lock in which the fuel discharged by the fuel pump cannot be pressurized, leading to misfires and the like.

Hence, Japanese Patent Application Publication No. 2005-076568 (JP-A-2005-076568), for example, discloses an apparatus that calculates a correction value for correcting a target fuel pressure on the basis of a variation rate (pressure variation width/central pressure) of a fuel pressure in a fuel supply pipe for supplying fuel to a port injection valve, detects fuel vapor lock from an increase in the variation rate (pressure variation width/central pressure), and sets the correction value such that when fuel vapor lock occurs, the target fuel pressure is increased.

Further, Japanese Patent Application Publication No. 2006-200423 (JP-A-2006-200423), for example, discloses an apparatus including a sensor that detects a pressure of fuel fed to a high pressure fuel pump from a low pressure fuel pump, wherein an air mixing amount is estimated on the basis of a pressure detection value obtained by the sensor, and an air bleeding control valve that removes air from the fuel on an upstream side of the high pressure fuel pump when the air mixing amount reaches or exceeds a predetermined value.

Furthermore, Japanese Patent Application Publication No. 2001-165013 (JP-A-2001-165013), for example, discloses an apparatus in which a return control valve and a fuel temperature sensor are respectively disposed in a return passage of a high pressure regulator that regulates a discharge pressure of a high pressure fuel pump, wherein the return control valve is capable of limiting a flow rate of return fuel passing through the return passage, first and second orifices are provided in a downstream side passage for returning fuel to a fuel tank from the return control valve, and by leading an inter-orifice fuel pressure to an opening pressure varying port of a low pressure regulator that regulates the pressure (a feed fuel pressure) of fuel delivered to the high pressure fuel pump from a low pressure fuel pump, the feed fuel pressure is increased when the return control valve is opened (at a high fuel temperature).

Furthermore, Japanese Patent Application Publication No. 2010-071244 (JP-A-2010-071244), for example, discloses an apparatus that avoids a discharge defect in a high pressure fuel pump while suppressing a power consumption of a low pressure fuel pump by setting a feed fuel pressure fed to the high pressure fuel pump at an identical value to a sum of a saturated vapor pressure and a pressure loss or, taking into account variation in fuel properties and the pressure loss, a larger value than the sum.

In the fuel supply apparatuses for an internal combustion engine described above, however, the pressure (feed fuel pressure) of the fuel supplied to the fuel injection valve is controlled to the high pressure side after pressure variation has actually occurred (for example, fuel vapor lock is detected when the fuel pressure variation rate has become sufficiently large), and therefore rotation variation and air-fuel ratio variation are likely to occur due to a reduction in a fuel injection pressure.

In response to this problem, a fuel temperature sensor may be used to detect, from the fuel temperature, that a condition in which fuel vapor is likely to be generated is not yet established. In this case, however, the fuel temperature must be detected in a plurality of locations, leading to an increase in cost.

Further, when fuel vapor generation is estimated from other sensor information, a high feed fuel pressure must be set to ensure a sufficient margin relative to comparatively large variation in the estimated value. As a result, a fuel efficiency of the engine decreases, and the fuel pump deteriorates in a comparatively short period.

Furthermore, a fuel vapor generation condition (a condition in which the fuel temperature rises to a fuel vapor generation temperature) may be stored such that the fuel pressure is increased when the condition is satisfied. Likewise in this case, however, the fuel pressure is increased more than necessary, leading to similar problems to those arising when fuel vapor generation is estimated from other sensor information.

Hence, in the fuel supply apparatuses for an internal combustion engine according to the related art described above, either fuel vapor generation is suppressed by providing temperature sensors in a large number of locations, leading to a cost increase, or the fuel pressure is increased in advance on the basis of other sensor information such that the fuel pressure cannot be modified in an appropriate and timely fashion, leading to reductions in the fuel efficiency and the lifespan of the low pressure fuel pump.

SUMMARY OF THE INVENTION

Therefore, the invention provides a fuel supply apparatus for an internal combustion engine, which is capable of suppressing fuel vapor generation effectively at low cost by modifying a fuel pressure in an appropriate and timely fashion without producing rotation variation and air-fuel ratio variation in the internal combustion engine due to a reduction in a fuel injection pressure and without causing reductions in a fuel efficiency and a lifespan of a low pressure fuel pump.

A fuel supply apparatus for an internal combustion engine according to an aspect of the invention includes: a low pressure fuel pump capable of feeding a fuel of the internal combustion engine; a high pressure fuel pump that pressurizes and discharges the fuel fed from the low pressure fuel pump; a high pressure fuel injection valve that supplies the fuel pressurized by the high pressure fuel pump to the internal combustion engine selectively; variation amount detecting means for detecting a variation amount in a pressure of the fuel fed from the low pressure fuel pump to the high pressure fuel pump; and feeding condition determining means for determining that a condition variation causing fuel vapor to form in the fuel fed to the high pressure fuel pump has occurred when the variation amount detected by the variation amount detecting means falls to a preset threshold variation amount.

With this constitution, in the fuel supply apparatus for an internal combustion engine according to an aspect of the invention, the variation amount in the pressure (also referred to as a feed fuel pressure hereafter) of the fuel fed from the low pressure fuel pump to the high pressure fuel pump is detected by the variation amount detecting means, and when the detected variation amount decreases to the preset threshold variation amount, the feeding condition determining means determines that the condition variation causing fuel vapor to form in the fuel fed to the high pressure fuel pump has occurred. Hence, when the pressure variation in the fuel supplied from the low pressure fuel pump to the high pressure fuel pump attenuates, fuel vapor suppression control may be started by switching the feed fuel pressure fed to the high pressure fuel pump to a high pressure or the like, for example, before the high pressure fuel pump becomes filled with fuel vapor so that it becomes impossible to pressurize the fuel to a high pressure, and as a result, fuel vapor lock may be forestalled. Note that a time exceeding several seconds (for example, between approximately 20 and 30 seconds) is required from a point at which the pressure variation in the fuel in a fuel supply pipe, to be fed to the high pressure fuel pump, attenuates rapidly to a point at which the high pressure fuel pump is filled with fuel vapor, but the fuel vapor suppression control may be executed early within this time.

Further, in the fuel supply apparatus for an internal combustion engine according to the aspect described above, a normal pressure of the fuel fed to the high pressure fuel pump may be a pressure at which the variation amount exceeds the threshold variation amount, and the fuel supply apparatus for an internal combustion engine may further include fed fuel pressure varying means for switching the pressure of the fuel fed to the high pressure fuel pump to a higher pressure than the normal pressure when the feeding condition determining means determines that the condition variation causing fuel vapor to form in the fuel fed to the high pressure fuel pump has occurred.

With this constitution, when the variation amount of the feed fuel pressure falls to the threshold variation amount such that the condition variation causing fuel vapor to form in the fuel fed to the high pressure fuel pump is determined to have occurred, the pressure of the fuel fed to the high pressure fuel pump is switched to a higher pressure than normal by the fed fuel pressure varying means. By switching the feed fuel pressure to a high pressure before the high pressure fuel pump becomes filled with fuel vapor, it is possible to forestall fuel vapor lock in which the fuel in the high pressure fuel pump may no longer be pressurized.

Further, in the fuel supply apparatus for an internal combustion engine according to the aspect described above, the fed fuel pressure varying means may hold the pressure of the fuel fed to the high pressure fuel pump at the higher pressure than the normal pressure for at least a preset fixed time from a point at which the variation amount detected by the variation amount detecting means falls to the threshold variation amount. As a result, it is possible to prevent the high pressure fuel pump from becoming filled with fuel vapor sufficiently.

The fuel supply apparatus for an internal combustion engine according to the aspect described above may further include: a high pressure side fuel pressure sensor that detects a pressure of the fuel pressurized by the high pressure fuel pump; and high pressure fuel pump controlling means for controlling the high pressure fuel pump on the basis of the pressure detected by the high pressure side fuel pressure sensor so that the pressure of the fuel pressurized by the high pressure fuel pump approaches a target pressure, wherein the fed fuel pressure varying means may cancel a high pressure holding condition in which the pressure of the fuel fed to the high pressure fuel pump is held at the higher pressure than the normal pressure when the pressure detected by the high pressure side fuel pressure sensor reaches a preset target pressure level. In this case, the high pressure holding condition is maintained in the fuel fed to the high pressure fuel pump until the pressure detected by the high pressure side fuel pressure sensor reaches the preset target pressure level after the variation amount detected by the variation amount detecting means has fallen to the threshold variation amount. Therefore, the fuel pressure may be modified in an accurate and timely fashion, whereby fuel vapor generation is suppressed effectively.

The fuel supply apparatus for an internal combustion engine according to the aspect described above may further include: a high pressure side fuel pressure sensor that detects a pressure of the fuel pressurized by the high pressure fuel pump; and high pressure fuel pump controlling means for controlling the high pressure fuel pump on the basis of the pressure detected by the high pressure side fuel pressure sensor so that the pressure of the fuel pressurized by the high pressure fuel pump approaches a target pressure, wherein the fed fuel pressure varying means may cancel a high pressure holding condition in which the pressure of the fuel fed to the high pressure fuel pump is held at the higher pressure than the normal pressure when a discharge flow rate of the high pressure fuel pump reaches a preset normal flow rate level. In this case, the high pressure holding condition is maintained in the fuel fed to the high pressure fuel pump until the discharge flow rate of the high pressure fuel pump reaches the preset normal flow rate level after the variation amount detected by the variation amount detecting means has fallen to the threshold variation amount. Therefore, the fuel pressure may be modified in an accurate and timely fashion, whereby fuel vapor generation is suppressed effectively.

Further, in the fuel supply apparatus for an internal combustion engine according to the aspect described above, the target pressure may be set in advance in accordance with an operating condition of the internal combustion engine to a pressure enabling an in-cylinder injection.

Furthermore, in the fuel supply apparatus for an internal combustion engine according to the aspect described above, the fed fuel pressure varying means may cancel a high pressure holding condition in which the pressure of the fuel fed to the high pressure fuel pump is held at the higher pressure than the normal pressure, upon establishment of a condition in which the internal combustion engine is operated in a condition where an open period of the high pressure fuel injection valve exceeds a preset threshold injection period. In this case, the high pressure holding condition is maintained in the fuel fed to the high pressure fuel pump until the discharge flow rate of the high pressure fuel pump reaches the normal flow rate level. Therefore, the fuel pressure may be modified in an accurate and timely fashion, whereby fuel vapor generation is suppressed effectively.

Further, in the fuel supply apparatus for an internal combustion engine according to the aspect described above, the high pressure fuel injection valve may be configured to include a plurality of in-cylinder injection injectors, the number of which corresponds to the number of cylinders in the internal combustion engine, and the variation amount detecting means may detect the variation amount in the pressure of the fuel fed to the high pressure fuel pump, upon establishment of a condition in which the plurality of in-cylinder injection injectors are respectively closed while the internal combustion engine is operative. In this case, the variation amount detecting means detects the variation amount in the pressure of the fuel fed to the high pressure fuel pump when the plurality of in-cylinder injection injectors are respectively closed such that an internal temperature of the high pressure fuel pump is more likely to rise, and therefore the feed fuel pressure is increased only if necessary. Hence, as well as forestalling fuel vapor lock in the high pressure fuel pump, the normal feed fuel pressure may be suppressed to a low pressure, and as a result, reductions in fuel efficiency and the lifespan of the low pressure fuel pump may be prevented.

The fuel supply apparatus for an internal combustion engine according to the aspect described above may further include a low pressure fuel injection valve that supplies the fuel fed from the low pressure fuel pump to the internal combustion engine selectively, wherein the low pressure fuel injection valve may be configured to include a plurality of port injection injectors, the number of which corresponds to the number of cylinders in the internal combustion engine, and the variation amount detecting means may detect the variation amount in the pressure of the fuel fed to the high pressure fuel pump, upon establishment of a condition in which the plurality of in-cylinder injection injectors and the plurality of port injection injectors are respectively closed while the internal combustion engine is operative. In this case, the variation amount detecting means detects the variation amount in the pressure of the fuel fed to the high pressure fuel pump when the in-cylinder injection injectors and the port injection injectors are respectively closed such that a temperature of an entire fuel system is more likely to rise, and therefore the feed fuel pressure is increased only if necessary. Hence, as well as forestalling fuel vapor lock in the high pressure fuel pump, the normal feed fuel pressure may be suppressed to a low pressure, and as a result, reductions in fuel efficiency and the lifespan of the low pressure fuel pump may be prevented. In other words, the fuel vapor suppression control may be executed only when required.

Further, in the fuel supply apparatus for an internal combustion engine according to the aspect described above, the condition in which the plurality of in-cylinder injection injectors are respectively closed while the internal combustion engine is operative may correspond to a fuel cut condition in which a fuel supply from the high pressure fuel injection valve is temporarily stopped while the internal combustion engine is operative. In this case, the feed fuel pressure may be increased reliably when the plurality of in-cylinder injection injectors are closed for a comparatively long time such that the internal temperature of the high pressure fuel pump increases.

The fuel supply apparatus for an internal combustion engine according to the aspect described above may further include a low pressure fuel injection valve that supplies the fuel fed from the low pressure fuel pump to the internal combustion engine selectively, wherein the low pressure fuel injection valve may be configured to include a plurality of port injection injectors, the number of which corresponds to the number of cylinders in the internal combustion engine, the internal combustion engine may include a plurality of banks, each having a plurality of cylinders, the high pressure fuel pump may be mounted on a bank on one side, from among the plurality of banks, and the variation amount detecting means may include a low pressure side fuel pressure sensor that detects a pressure of the fuel fed from the low pressure fuel pump to a port injection injector mounted on the bank on the one side, from among the plurality of port injection injectors. In this case, the low pressure side fuel pressure sensor is disposed in an environment close to a disposal environment of the high pressure fuel pump, and therefore the feed fuel pressure may be increased reliably when the internal temperature of the high pressure fuel pump increases.

Further, in the fuel supply apparatus for an internal combustion engine according to the aspect described above, the variation amount detecting means may detect a variation width per predetermined time of the pressure of the fuel fed from the low pressure fuel pump to the high pressure fuel pump, and the feeding condition determining means may determine that the condition variation causing fuel vapor to form in the fuel fed to the high pressure fuel pump has occurred on the basis of a variation rate of the variation width when the variation width of the pressure of the fuel detected by the variation amount detecting means falls to the preset threshold variation amount. In this case, it is possible to detect the condition variation causing fuel vapor to form in the fuel fed to the high pressure fuel pump swiftly and accurately.

Note that in the fuel supply apparatus for an internal combustion engine according to the aspect of the invention described above, when the threshold variation amount is set at a threshold variation width of the feed fuel pressure in a case where a pulsation damper capable of absorbing a part of the pressure variation in the fuel in a low pressure fuel pipe extending from the low pressure fuel pump to the plurality of port injection injectors is mounted on the low pressure fuel pipe, the threshold variation amount may be set at a smaller value than a variation width of the pressure detected by the low pressure side fuel pressure sensor after a part of the pressure variation in the fuel is absorbed by the pulsation damper. Further, a discharge check valve that opens in a direction for supplying fuel from the high pressure fuel pump to the high pressure fuel injection valve and closes so as to prevent backflow of the fuel discharged from the high pressure fuel pump may be provided. In this case, the discharge check valve is opened by a front-rear differential pressure not exceeding the pressure of the fuel fed from the low pressure fuel pump when the high pressure fuel pump is in a non-driven condition, and maintains the pressure of the fuel on the high pressure fuel injection valve side at a pressure exceeding the pressure of the fuel fed from the low pressure fuel pump.

According to the invention, a condition variation causing fuel vapor to form is determined to have occurred when the pressure variation amount of the fuel supplied from the low pressure fuel pump to the high pressure fuel pump attenuates to the threshold variation amount, and therefore fuel vapor suppression control such as switching the pressure of the fuel fed to the high pressure fuel pump to a high pressure before the high pressure fuel pump becomes filled with fuel vapor may be executed in order to forestall fuel vapor lock in which the fuel cannot be pressurized by the high pressure fuel pump. As a result, it is possible to provide a fuel supply apparatus for an internal combustion engine that may effectively suppress fuel vapor generation at low cost by modifying the fuel pressure in an accurate and timely fashion without producing rotation variation and air-fuel ratio variation in the internal combustion engine due to a reduction in a fuel injection pressure and without causing reductions in the fuel efficiency and the lifespan of the low pressure fuel pump.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

An embodiment of the invention will be described below with reference to the drawings.

FIGS. 1 to 4 show an embodiment of a fuel supply apparatus for an internal combustion engine according to the invention.

Figure 1:
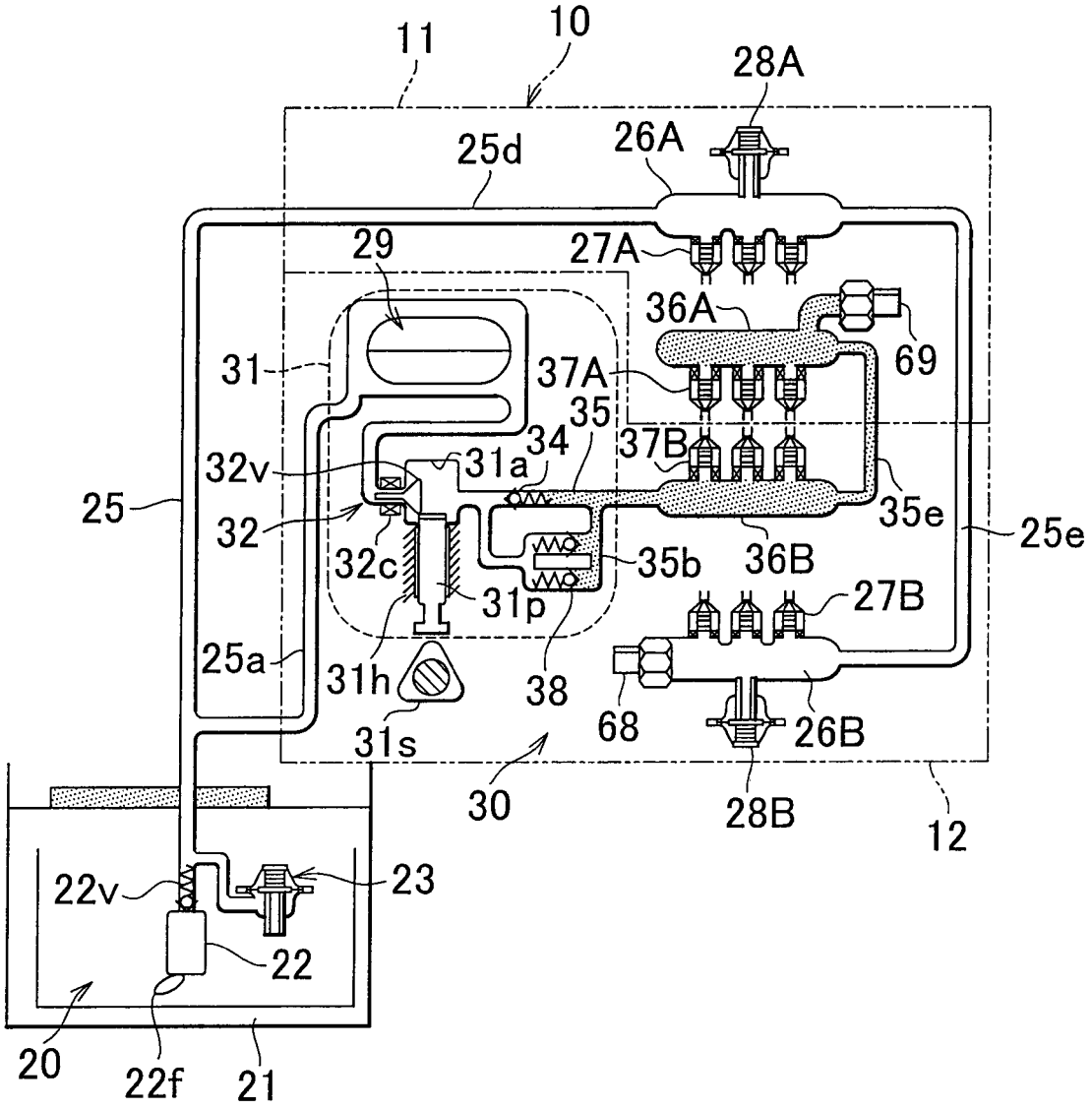
FIG. 1 is a schematic diagram of a fuel supply apparatus for an internal combustion engine according to an embodiment of the invention.

An engine 10 according to this embodiment, shown in FIG. 1, is constituted by a V type six-cylinder engine (a multi-cylinder internal combustion engine) having a first bank 11 and a second bank 12 including three cylinders each. Although not shown in detail in the drawing, a piston, not shown in the drawing, is housed in each cylinder, a combustion chamber is defined in each cylinder, and an intake valve and an exhaust valve are provided in each cylinder so as to open and close at predetermined timings. The engine 10 is further provided with an ignition apparatus (to be described below) having a spark plug that is exposed to the interior of the combustion chamber and an ignition coil for igniting the spark plug, for example, and the fuel supply apparatus according to this embodiment.

The fuel supply apparatus according to this embodiment, provided in the engine 10, is constituted by a first fuel supply mechanism 20 that supplies low pressure side fuel (gasoline, for example) used for a port injection and a second fuel supply mechanism 30 that supplies high pressure side fuel used for an in-cylinder injection.

The first fuel supply mechanism 20 is constituted by a feed pump 22 (a low pressure fuel pump) that suctions fuel from a fuel tank 21 and discharges fuel pressurized to a first pressure level, a feed fuel pressure regulating device 23 capable of switching a set pressure in order to regulate the fuel discharged from the feed pump 22 into a first fuel pipe 25 (a low pressure fuel pipe) to one of two preset set pressures, namely a low pressure side feed fuel pressure and a high pressure side feed fuel pressure, low pressure side delivery pipes 26A, 26B into which the fuel discharged into the first fuel pipe 25 from the feed pump 22 and regulated by the feed fuel pressure regulating device 23 is introduced and accumulated via the first fuel pipe 25, three port injection first injectors 27A (a plurality of low pressure fuel injection valves, port injection valves) for injecting the fuel into the interior of three intake ports corresponding to the three cylinders (although not shown in the drawing, a first cylinder, a third cylinder, and a fifth cylinder from a front side, for example) of the first bank 11 on an intake passage (not shown) of the engine 10, three port injection first injectors 27B (a plurality of low pressure fuel injection valves, port injection valves) for injecting the fuel into the interior of three intake ports corresponding to the three cylinders (a second cylinder, a fourth cylinder, and a sixth cylinder from the front side, for example) of the second bank 12, pulsation dampers 28A, 28B that are mounted on the low pressure side delivery pipes 26A, 26B to absorb and suppress fuel pressure pulsation in the interior thereof, and a low pressure fuel pressure sensor 68 (a low pressure side fuel pressure sensor) that detects a fuel pressure in the furthest downstream low pressure side delivery pipe 26B. Note that here, the fuel pipe denotes an arbitrary member used to form a fuel passage, and therefore this member is not limited to a fuel pipe and may be a single member through which a fuel passage is formed or a plurality of members between which a fuel passage is formed.

The feed pump 22 is a conventional variable fuel pressure type pump that is driven ON and OFF via a pump driving circuit 84 on the basis of a control signal from an electronic control unit (ECU) 50 and controls a discharge amount or a discharge pressure variably in accordance with a drive current from the pump driving circuit 84. A suction filter 22*f* that prevents foreign matter from being suctioned into the feed pump 22 is provided on a suction port side of the feed pump 22, while a fuel filter, not shown in the drawing, that removes foreign matter from discharged fuel and a discharge check valve 22*v* that prevents backflow of the discharged fuel are provided on a discharge port side of the feed pump 22. Further, although not shown in detail in the drawing, the feed pump 22 includes a pump activating part having a pump activating impeller and an inbuilt direct current motor for driving the pump activating part, and by varying a rotation speed [rpm] of the inbuilt motor, a discharge amount per unit time of the feed pump 22 can be variably controlled. The discharge check valve 22*v* prevents backflow of the discharged fuel by opening in a direction in which the fuel is discharged from the fuel pump 22 and closing in a direction in which the discharged fuel flows back to the feed pump 22 side.

Although not shown in detail in the drawing, the feed fuel pressure regulating device 23 capable of switching a pressure regulation level of the feed fuel pressure is configured to connect the high pressure regulator that regulates the feed fuel pressure to a high pressure side feed fuel pressure to the first fuel pipe 25 at all times, for example, and to be capable of connecting a low pressure regulator portion capable of regulating the feed fuel pressure in the first fuel pipe 25 to a low pressure side feed fuel pressure to the first fuel pipe 25 selectively using a fuel pressure switching solenoid opening/closing valve 83 (FIG. 2) (a pressure regulation level switching system such as that described in Japanese Patent Application Publication No. 2008-157029 (JP-A-2008-157029), for example). Note that the feed fuel pressure regulating device 23 may be constituted by a low pressure regulator portion that is connected to the first fuel pipe 25 on an inlet side and opens into the fuel tank 21 via a throttle element on an outlet side (a fuel tank side), and a high pressure regulator portion that is connected to the first fuel pipe 25 on the inlet side and opens into the fuel tank 21 on the outlet side (see Japanese Patent Application Publication No. 2007-303372 (JP-A-2007-303372), for example). Further, the low pressure regulator portion and the high pressure regulator portion described here respectively include a diaphragm serving as a valve body that receives the pressure of the fuel discharged from the feed pump 22 in an opening direction and a compression coil spring that biases the diaphragm in a closing direction, and regulate the fuel pressure in the first fuel pipe 25 to the respective set pressures by opening when the fuel pressure received by the diaphragm exceeds the respective set pressures and remaining closed as long as the fuel pressure received by the diaphragm does not satisfy the respective set pressures. Needless to mention, the feed fuel pressure regulating device 23 may be constituted by another conventional pressure regulating device capable of switching a set pressure, or a variable pressure regulator capable of switching the pressure regulation level between a low pressure and a high pressure by opening and closing a plurality of fluid introduction ports so as to switch a pressure-receiving surface area of the diaphragm between a large surface area and a small surface area.

The low pressure side delivery pipes 26A, 26B are respectively connected to downstream side parts 25*d*, 25*e* of the first fuel pipe 25 and connected to each other in series. Further, the first injectors 27A and the first injectors 27B are mounted on the low pressure side delivery pipe 26A and the low pressure side delivery pipe 26B, respectively.

Although not shown in detail in the drawings, the port injection first injectors 27A, 27B respectively include a solenoid valve portion that is driven to open by an injection command signal from the ECU 50 via an injector driver circuit 51, and a nozzle portion that opens so as to inject fuel into the corresponding intake port through an injection hole portion exposed to the interior of the intake port when the solenoid valve portion is energized. When one of the plurality of first injectors 27A, 27B is operated to open, the pressurized fuel in the low pressure side delivery pipe 26A or 26B is injected into the corresponding intake port through the injection hole portion in the first injector 27A or 27B.

The pulsation dampers 28A, 28B are mounted on the respective low pressure side delivery pipes 26A, 26B (or the first fuel pipe 25 if so desired) serving as a part of a low pressure fuel pipe extending from the feed pump 22 to the port injection first injectors 27A, 27B, and are capable of suppressing pressure variation in the fuel in the low pressure side delivery pipes 26A, 26B by absorbing a part of the pressure variation.

The second fuel supply mechanism 30 includes a plunger type high pressure fuel pump 31 (a fuel pressurizing pump) that suctions the fuel pressurized by the feed pump 22 and pressurizes the fuel to a second pressure level that is higher than the first pressure level, high pressure side delivery pipes 36A, 36B into which the fuel pressurized to the second pressure level is introduced and accumulated via a second fuel pipe 35, a plurality of in-cylinder injection second injectors 37A (high pressure fuel injection valves, in-cylinder injection valves) for injecting the fuel into the interior of the three cylinders (the first cylinder, the third cylinder, and the fifth cylinder, for example) of the first bank 11, a plurality of in-cylinder injection second injectors 37B (high pressure fuel injection valves, in-cylinder injection valves) for injecting the fuel into the interior of the three cylinders (the second cylinder, the fourth cylinder, and the sixth cylinder, for example) of the second bank 12, and a high pressure fuel pressure sensor 69 (a high pressure side fuel pressure sensor) that detects a fuel pressure in the furthest downstream high pressure side delivery pipe 36A.

The high pressure fuel pump 31 includes a pressurizing chamber 31*a* into which the fuel that is pressurized by the feed pump 22 and regulated by the feed fuel pressure regulating device 23 is introduced via a branch pipe 25*a* of the first fuel pipe 25. The high pressure fuel pump 31 pressurizes the fuel in the pressurizing chamber 31*a* to the second fuel pressure level that is higher than the first fuel pressure level, and then discharges the pressurized fuel to a second fuel pipe 35 on the side of the in-cylinder injection second injectors 37A, 37B. The high pressure fuel pump 31 is mounted on a bank on one side of the engine 10, for example the second bank 12, and driven by rotary power from a crankshaft, not shown in the drawing.

The high pressure fuel pump 31 further includes a plunger 31*p* provided to be capable of reciprocating within a pump housing 31*h*, a cam shaft 31*s* that drives the plunger 31*p* to ascend and descend in an up-down direction of the drawing, a spring, not shown in the drawing, that biases the plunger 31*p* to the cam shaft 31*s* side, and so on, and is capable of executing intake, pressurization, and discharge operations on the fuel from the feed pump 22 by varying a volume of the pressurizing chamber 31*a*, which is defined by the pump housing 31*h* and the plunger 31*p*, in accordance with the reciprocating motion of the plunger 31*p*. Further, a discharge check valve 34 including a spring, which opens when a discharge pressure of the fuel discharged from the high pressure fuel pump 31 exceeds a predetermined pressure value (approximately several tens of kPa, for example), thereby permitting the fuel to be supplied to the in-cylinder injection second injectors 37A, 37B, is provided in an upstream side part of the second fuel pipe 35 between the high pressure fuel pump 31 and the in-cylinder injection second injectors 37A, 37B. Furthermore, a bypass pipe portion 35*b* that bypasses the discharge check valve 34 is provided in the second fuel pipe 35, and a pair of mutually parallel check valves 38 including springs are provided as relief valves in the bypass pipe portion 35*b* in opposite orientations to the discharge check valve 34. The check valves 38 open when the pressure of the fuel in the second fuel pipe 35 and the high pressure side delivery pipes 36A, 36B on a downstream side of the discharge check valve 34, or in other words in a high pressure zone, exceeds a predetermined high pressure side limit pressure (several MPa, for example), and are thereby capable of limiting the fuel pressure in the high pressure zone to the high pressure side limit pressure.

Further, a solenoid spill valve 32 that has a check valve function for preventing a high pressure backflow and opens in response to an input signal so as to cause the fuel in the pressurizing chamber 31*a* to flow to the low pressure side in accordance with the movement of the plunger 31*p* is provided on a fuel introduction port side of the pressurizing chamber 31*a* of the high pressure fuel pump 31. Furthermore, a pulsation damper 29 connected to a branch pipe 25*a* of the first fuel pipe 25, to which the fuel from the feed pump 22 side is fed, is provided in the vicinity of the pressurizing chamber 31*a* of the high pressure fuel pump 31 in order to absorb and thereby suppress pressure pulsation in the branch passage 25*a* caused by fuel injection and so on. Note that the pulsation damper 29 is a conventional component having in its interior an elastic diaphragm for receiving fuel pressure and a spring, for example, whereby an internal volume of the pulsation damper 29 is varied by elastically deforming the diaphragm.

The solenoid spill valve 32 includes a poppet-shaped valve body 32*v*, an electromagnetic driving coil 32*c* that drives the valve body 32*v* electromagnetically, and a spring, not shown in the drawing, that biases the valve body 32*v* in an opening direction at all times. The valve body 32*v* is operated to open and close in accordance with a closing direction electromagnetic biasing force generated by the electromagnetic driving coil 32*c*, the fuel pressure from the feed pump 22, and the fuel pressure in the pressurizing chamber 31*a*. The solenoid spill valve 32 closes when the closing direction electromagnetic biasing force is generated by the electromagnetic driving coil 32*c* so that the high pressure fuel pump 31 can perform a pressurizing operation on the fuel in the pressurizing chamber 31*a*, and opens when the closing direction electromagnetic biasing force is not generated by the electromagnetic driving coil 32*c* so that the high pressure fuel pump 31 can perform a suction operation. Further, the solenoid spill valve 32 is always open when the electromagnetic driving coil 32*c* is not energized, whereby the fuel pressurization and discharge operations of the high pressure fuel pump 31 can be halted.

The solenoid spill valve 32 is drive-controlled by the ECU 50 via the injector driver circuit 51, and for this purpose, the electromagnetic driving coil 32*c* of the solenoid spill valve 32 is connected to the injector driver circuit 51.

The discharge check valve 34 is closed and opened by causing a spherical valve body to contact and separate from a ring-shaped valve seat. The discharge check valve 34 opens and closes in accordance with a front-rear differential pressure of the valve body and a biasing force of a spring that biases the valve body in a closing direction. When the discharge check valve 34 opens in a fuel supply direction extending from the high pressure fuel pump 31 to the side of the in-cylinder injection second injectors 37A, 37B, the discharge check valve 34 opens at a front-rear differential pressure approximately equal to or lower than the fuel pressure from the feed pump 22.

With respect to a front-rear differential pressure in a direction for causing the fuel discharged from the high pressure fuel pump 31 to flow back, on the other hand, the discharge check valve 34 can be maintained in a closed condition even when the differential pressure is high. Further, at an initial stage where the high pressure fuel pump 31 is not driven and the fuel pressure in the high pressure zone on the side of the second injectors 37A, 37B relative to the discharge check valve 34 has not been pressurized to the predetermined pressure, the discharge check valve 34 can be opened by a front-rear differential pressure (approximately several tens of kPa) not exceeding the fuel pressure from the feed pump 22.

In the second fuel pipe 35, the bypass pipe portion 35*b* that bypasses the discharge check valve 34 bifurcates into two parallel passages, in which the pair of check valves 38 are disposed as relief valves, in an intermediate portion thereof. The pair of check valves 38 are closed and opened by causing a spherical valve body to contact and separate from a ring-shaped valve seat, and are disposed in an opposite orientation to the discharge check valve 34. The check valves 38 are similar to the discharge check valve 34 in that they open and close in accordance with a front-rear differential pressure of the valve body and a biasing force of a spring that biases the valve body in a closing direction, but the biasing force of the spring is increased and/or a pressure-receiving surface area of the spherical valve body is reduced relative to the discharge check valve 34 such that a set pressure employed when the check valves 38 function as relief valves for limiting the pressure in the high pressure zone is set at approximately several MPa (2.5 MPa, for example), which is considerably larger than the valve opening pressure of the discharge check valve 34.

A high pressure accumulation chamber having a substantially circular cross-section is defined in the high pressure side delivery pipes 36A, 36B by a substantially pipe-shaped forged, cast, or injection molded metallic member having one open end, and a closing plug member that closes the open end side of the metallic member. The high pressure side delivery pipes 36A, 36B are connected to each other in series via a downstream side part 35*e* of the second fuel pipe 35, and fastened/fixed to an engine main body of the engine 10.

Although not shown in detail in the drawing, the plurality of second injectors 37A, 37B respectively include a solenoid valve portion that is driven to open by an injection command signal from the ECU 50 via the injector driver circuit 51 (see FIG. 2), and a nozzle portion that has an injection hole portion exposed to a combustion chamber of each cylinder and opens so as to inject fuel into the corresponding cylinder through the injection hole portion when the solenoid valve portion is energized. The second injectors 37A, 37B are disposed to correspond to the plurality of cylinders of the engine 10, and are pipe-connected to and supported by the high pressure side delivery pipes 36A, 36B at a substantially constant pitch. When one of the plurality of second injectors 37A, 37B is operated to open, the pressurized high pressure fuel in the high pressure side delivery pipe 36A or 36B is injected into the combustion chamber of the corresponding cylinder through the injection hole portion in the second injector 37A or 37B.

A detailed hardware configuration of the ECU 50 is not shown in the drawing, but the ECU 50 includes a central processing unit (CPU), a read only memory (ROM), a random access memory (RAM), and a backup memory constituted by a nonvolatile memory, and also includes an input interface circuit having an analog-to-digital (A/D) converter and so on, an output interface circuit having a driver and a relay switch, and a constant voltage circuit.

Figure 2:
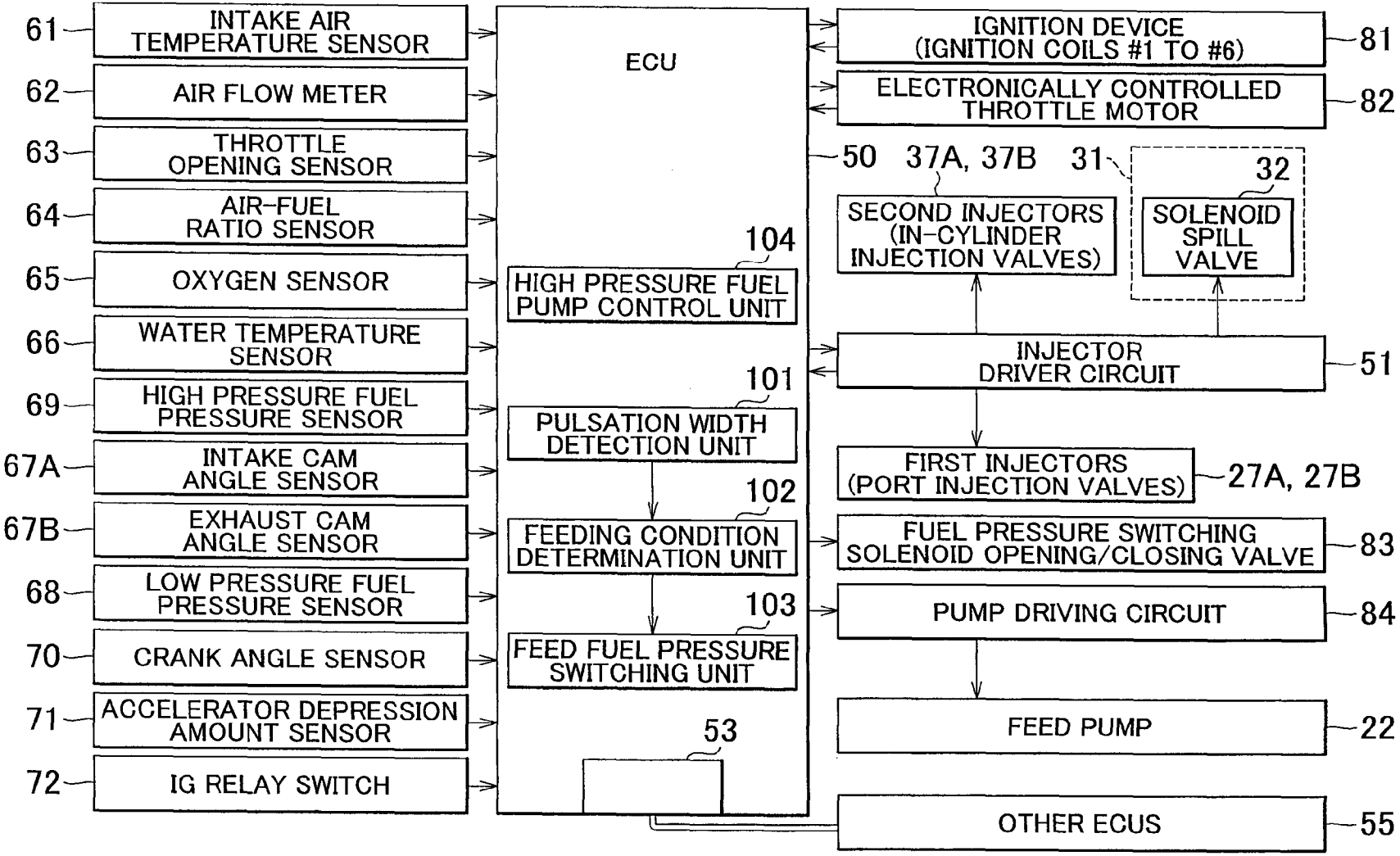
FIG. 2 is a block diagram showing a control system for controlling the fuel supply apparatus for an internal combustion engine according to this embodiment of the invention.

As shown in FIG. 2, an intake air temperature sensor 61, an air flow meter 62, a throttle opening sensor 63, an air-fuel ratio sensor 64, an oxygen sensor 65, a water temperature sensor 66, intake and exhaust cam angle sensors 67A, 67B, a low pressure fuel pressure sensor 68, a high pressure fuel pressure sensor 69, and a crank angle sensor 70, an accelerator depression amount sensor 71, an ignition relay switch 72, and so on, all of which are available in the related art, are connected to the input interface circuit of the ECU 50. Note that the low pressure fuel pressure sensor 68 detects the pressure of the fuel fed from the feed pump 22 to the port injection first injectors 27A, 27B on a furthest downstream side by detecting the fuel pressure in the low pressure side delivery pipe 26B, whereas the high pressure fuel pressure sensor 69 detects the pressure of the fuel pressurized by the high pressure fuel pump 31 and fed from the high pressure fuel pump 31 to the in-cylinder injection second injectors 37A, 37B on a furthest downstream side by detecting the fuel pressure in the high pressure side delivery pipe 36A.

Further, other ECUs 55, such as a transmission control computer (TCC), are connected to a communication port 53 of the ECU 50. Furthermore, an ignition device 81 having a plurality of ignition coils corresponding to the first to sixth cylinders (represented by #1 to #6 in the drawing) of the engine 10, an electronically controlled throttle motor 82 that operates an electronically controlled throttle valve, the injector driver circuit 51 that outputs injection command signals to the first injectors 27A, 27B and second injectors 37A, 37B and a closing drive signal to the solenoid spill valve 32, the fuel pressure switching solenoid opening/closing valve 83, and the pump driving circuit 84 that executes ON/OFF control and discharge amount variation control on the feed pump 22 are connected to the output interface circuit of the ECU 50.

In accordance with a control program stored in advance in the ROM, the ECU 50 calculates a fuel injection amount corresponding to operating conditions of the engine 10, an acceleration request, and so on, for example, on the basis of sensor information from the various sensors 61 to 72, set value information stored in the backup memory, maps stored in advance in the ROM, and so on while communicating with the other (in-vehicle) ECUs 55, and outputs injection command signals to the first injectors 27A, 27B and second injectors 37A, 37B, a signal for driving the solenoid spill valve 32 to close, and so on at appropriate timings.

The ECU 50 is also capable of controlling the pressure of the fuel supplied to the high pressure side delivery pipes 36A, 36B from the high pressure fuel pump 31 to an optimum fuel pressure in accordance with the operating conditions of the engine 10 and injection characteristics of the in-cylinder injection second injectors 37A, 37B by adjusting at least an amount of fuel allowed to leak out of the pressurizing chamber 31*a* by the solenoid spill valve 32. For example, the ECU 50 is capable of setting an ON time, during which the electromagnetic driving coil 32*c* of the solenoid spill valve 32 is excited, and an OFF time, during which the excited condition is canceled, variably within a fixed signal period, and by varying a ratio of the ON time (0 to 100%; to be referred to hereafter as a duty ratio) within the signal period, the ECU 50 can control the timing of the fuel pressurization/discharge operations performed by the high pressure fuel pump 31 and the discharge amount of the high pressure fuel pump 31.

Further, the ECU 50 implements fuel injection by the port injection first injectors 27A, 27B for the first time when the engine 10 is started. If, in the meantime, a fuel pressure in the high pressure side delivery pipes 36A, 36B (to be referred to as a high pressure delivery fuel pressure hereafter), which is detected by the high pressure fuel pressure sensor 69, exceeds a preset pressure value close to the second pressure level, the ECU 50 determines that the second fuel pressure level required for fuel injection by the in-cylinder injection second injectors 37A, 37B is reachable, and accordingly begins to output the injection command signal to the in-cylinder injection second injectors 37A, 37B.

Furthermore, the ECU 50 implements the in-cylinder injection by the second injectors 37A, 37B as a default, for example, and additionally implements the port injection under specific operating conditions in which an air-fuel mixture is not formed sufficiently by the in-cylinder injection, for example when a startup/warm-up operation or a low-rotation, high-load operation is performed in the engine 10. The ECU 50 also executes the port injection from the first injectors 27A, 27B during a high-rotation, high-load operation or the like in which the port injection is effective.

Moreover, control programs, arithmetic expressions, maps, and so on corresponding to respective functions are stored/installed in the ROM of the ECU 50, and a plurality of function units to be described below are constituted thereby.

Specifically, the ECU 50 forms a pulsation width detection unit 101 that detects a fuel pressure pulsation width X (a variation width of the feed fuel pressure, a variation amount in the fuel pressure), which is a difference per predetermined detection period in the pressure of the fuel fed to the high pressure fuel pump 31 from the feed pump 22 or a difference between a maximum value and a minimum value of a detected pressure per predetermined detection period (the fuel pressure pulsation width X may also be an absolute value of a difference between an average pressure per predetermined detection period and the maximum value or the minimum value), for example, on the basis of the fuel pressure in the low pressure side delivery pipes 26B, i.e. detection information from the low pressure fuel pressure sensor 68, a feeding condition determination unit 102 (feeding condition determining means) that determines that a condition variation causing fuel vapor to form in the fuel fed to the high pressure fuel pump 31 has occurred on the basis of the fuel pressure pulsation width X detected by the pulsation width detection unit 101, and a feed fuel pressure switching unit 103 that switches the pressure of the fuel fed to the high pressure fuel pump 31, or in other words a feed fuel pressure, to a high pressure side feed fuel pressure that is higher than a normal low pressure side feed fuel pressure at which the fuel pressure pulsation width X exceeds a threshold variation width $\alpha$ when the feeding condition determination unit 102 determines that the condition variation causing fuel vapor to form in the fuel fed to the high pressure fuel pump 31 has occurred.

Here, the pulsation width detection unit 101 constitutes variation amount detecting means together with the low pressure fuel pressure sensor 68 that detects the port injection fuel pressure, and the threshold variation width $\alpha$, which is stored in advance in the pulsation width detection unit 101, is set at a smaller value than a variation amount in the fuel pressure during execution of the port fuel injection, which is detected by the low pressure fuel pressure sensor 68 after being partially absorbed by the pulsation dampers 28A, 28B or 29, for example a variation width in the detected value of the feed fuel pressure. More specifically, when a temperature increase occurs on a path for feeding fuel from the feed pump 22 to the side of the low pressure side delivery pipes 26A, 26B and the high pressure fuel pump 31 via the first fuel pipe 25 such that fuel vapor begins to form in the fuel traveling along the path, the fuel pressure pulsation width X of the feed fuel pressure detected by the low pressure fuel pressure sensor 68 attenuates rapidly, and therefore the fuel pressure pulsation width X becomes considerably smaller (smaller by approximately several tenths, for example) than a normal variation width. Accordingly, the threshold variation width $\alpha$ is set at a threshold that is smaller than the normal variation width but no smaller than the variation width generated when the feed fuel pressure attenuates rapidly. Note that the threshold variation width $\alpha$ is set at an optimum value together with other set values of the ECU 50 during adaptation and adjustment of the engine 10. Further, the fuel pressure variation amount detected by the variation amount detecting means is not limited only to the difference (a peak-peak value) between the maximum value and the minimum value of the detected value of the feed fuel pressure per fixed time period, which is taken into the ECU 50 at short period intervals, or in other words variation in the fuel pressure pulsation width X serving as the variation width of the feed fuel pressure, and in order to express the rapid attenuation occurring in the fuel pressure when fuel vapor begins to form in the fuel fed to the high pressure fuel pump 31 with a high degree of precision, the fuel pressure variation amount detected by the variation amount detecting means may be a variation amount obtained by implementing appropriate correction processing, averaging processing, or other processing on the fuel pressure detected value. Alternatively, the fuel pressure variation amount may be a variation amount for which a variation rate (an attenuation rate) of the feed fuel pressure per short first time period remains larger than a corresponding threshold variation rate continuously for a second time period, which is a plurality of times longer than the first time period.

Further, the feeding condition determination unit 102 determines that a condition variation causing fuel vapor to form in the fuel fed to the high pressure fuel pump 31 has occurred when the fuel pressure pulsation width X falls to the threshold variation width $\alpha$ at a faster variation rate than a preset variation rate $\beta$ (i.e. at a smaller variation rate than a value of the variation rate $\beta$, which is smaller than 1; a reduction rate per calculation period). Here, similarly to the threshold variation width $\alpha$, the variation rate $\beta$ is set at an optimum value together with other set values of the ECU 50 during adaptation and adjustment of the engine 10.

The feed fuel pressure switching unit 103 holds the pressure (the feed fuel pressure) of the fuel fed from the feed pump 22 to the high pressure fuel pump 31 at the high pressure side feed fuel pressure, which is higher than the normal low pressure side feed fuel pressure, for at least a preset fixed time from a point at which the fuel pressure pulsation width X detected by the pulsation width detection unit 101 falls to the threshold variation width $\alpha$.

More specifically, the feed fuel pressure switching unit 103 can hold the feed fuel pressure at the high pressure side feed fuel pressure by setting the fuel pressure switching solenoid opening/closing valve 83 of the feed fuel pressure adjustment device 23 in a closed condition so as to cut off the low pressure regulator portion of the feed fuel pressure adjustment device 23 from the first fuel pipe 25, and if necessary by variably controlling the discharge amount of the feed pump 22 via the pump driving circuit 84. In other words, the feed fuel pressure switching unit 103 constitutes feed fuel pressure varying means for switching the feed fuel pressure between the high pressure side feed fuel pressure and the low pressure side feed fuel pressure together with the fuel pressure switching solenoid opening/closing valve 83 and the pump driving circuit 84.

Further, the ECU 50 forms a high pressure fuel pump control unit 104 (high pressure fuel pump controlling means) that controls a closing driving timing and a closing driving time period applied to the solenoid spill valve 32 per predetermined period on the basis of the pressure detected by the high pressure fuel pressure sensor 69 and feedback-controls time periods of the fuel pressurization/discharge operations performed by the high pressure fuel pump 31 such that the pressure of the fuel pressurized by the high pressure fuel pump 31 approaches a target pressure for respective operating conditions (which is set in advance as a fuel injection pressure enabling the in-cylinder injection under the respective operating conditions). When the pressure detected by the high pressure fuel pressure sensor 69 reaches a preset normal target pressure level at which the in-cylinder injection is possible, for example, the feed fuel pressure switching unit 103 cancels the high pressure holding condition in which the pressure of the fuel fed to the high pressure fuel pump 31 from the feed pump 22 is held at the high pressure side feed fuel pressure that is higher than the normal feed fuel pressure, and returns the feed fuel pressure to the normal low pressure side feed fuel pressure. More specifically, when the pressure detected by the high pressure fuel pressure sensor 69 reaches the preset normal target pressure level at which the in-cylinder injection is possible, the feed fuel pressure switching unit 103 can return the feed fuel pressure to the low pressure side feed fuel pressure by setting the fuel pressure switching solenoid opening/closing valve 83 of the feed fuel pressure switching device 23 in a non-conductive open condition so as to connect the low pressure regulator portion of the feed fuel pressure adjustment device 23 to the first fuel pipe 25, and if necessary by variably controlling the discharge amount of the feed pump 22 via the pump driving circuit 84.

Note that the feed fuel pressure switching unit 103 may be configured to cancel the high pressure holding condition of the feed fuel pressure when a discharge flow rate of the high pressure fuel pump 31 reaches a preset normal flow rate level, or when the engine 10 is operated in a condition where an injection amount [$mm^3$/ms] of the in-cylinder injection second injectors 37A, 37B exceeds a fixed amount (i.e. a condition in which an open time period of the high pressure fuel injection valve per injection exceeds a preset threshold injection time period).

In this embodiment, the pulsation width detection unit 101 of the ECU 50 detects the fuel pressure pulsation width X of the pressure of the fuel fed from the feed pump 22 to the high pressure fuel pump 31 in particular when the in-cylinder injection second injectors 37A, 37B respectively shift to a closed condition while the engine 10 is operative or when the in-cylinder injection second injectors 37A, 37B and the first injectors 27A, 27B respectively shift to a closed condition while the engine 10 is operative. Here, a condition in which the in-cylinder injection second injectors 37A, 37B and the port injection first injectors 27A, 27B are closed while the engine 10 is operative corresponds to a fuel cut condition in which a fuel supply from the in-cylinder injection second injectors 37A, 37B and the port injection first injectors 27A, 27B is temporarily stopped when predetermined operating conditions are established in the engine 10 (for example, when an accelerator depression amount is zero during vehicle deceleration or downhill travel). When the ECU 50 determines on the basis of the sensor information that these predetermined operating conditions are established, a fuel cut flag (to be referred to hereafter as an F/C flag) is activated.

Next, actions will be described.

Figure 3:
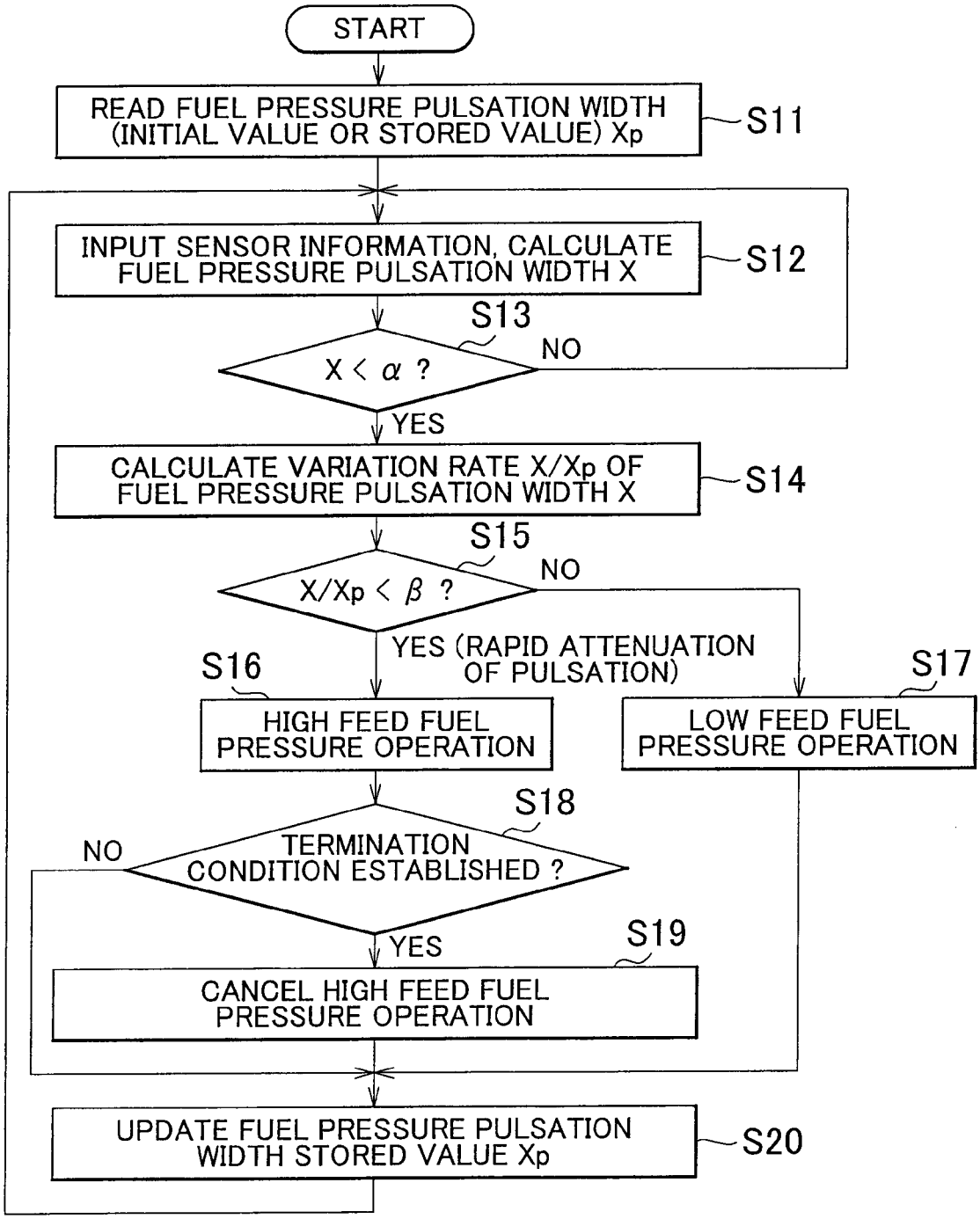
FIG. 3 is a flowchart showing an outline of procedures of a feed fuel pressure switching control program implemented in the fuel supply apparatus for an internal combustion engine according to this embodiment of the invention.

FIG. 3 shows an outline of processing procedures of a feed fuel pressure control program executed at predetermined time intervals during an operation of the engine 10 by the ECU 50 in a control apparatus for an internal combustion engine according to this embodiment of the invention. Further, FIG. 4 shows variation in a high pressure delivery fuel pressure [MPa] and a drive duty [%] of the high pressure fuel pump 31 before and after shifting to the fuel cut condition in the engine 10 according to the embodiment constituted as described above, together with variation in an oil temperature, a water temperature, and an intake air temperature [° C.] of the engine 10, a surface temperature of the high pressure fuel pump 31, the feed fuel pressure [kPa], and the F/C flag, in comparison with a comparative example.

In this feed fuel pressure control program, as shown in FIG. 3, first, a fuel pressure pulsation width Xp serving as an initial value or a previous stored value is read (Step S11), whereupon the fuel pressure in the low pressure side delivery pipe 26B, i.e. detected information from the low pressure fuel pressure sensor 68, is input and the fuel pressure pulsation width X of the feed fuel pressure fed from the feed pump 22 to the high pressure fuel pump 31 is calculated using a function of the pulsation width detection unit 101 (Step S12).

Next, using a function of the feeding condition determination unit 102, a determination is made as to whether or not the calculated fuel pressure pulsation width X is smaller than the threshold variation width α (Step S13). When it is determined that the fuel pressure pulsation width X is smaller than the threshold variation width α (YES in Step S13), a variation rate X/Xp serving as a ratio between the fuel pressure pulsation width X and the previously calculated and stored fuel pressure pulsation width Xp is calculated (Step S14), whereupon a determination is made as to whether or not the variation rate X/Xp is smaller than the preset variation rate β within the predetermined time, or in other words whether or not the fuel pressure pulsation width X has fallen to the threshold variation width α at a rapid reduction speed (corresponding to a smaller reduction rate than the variation rate β) no lower than a reduction speed corresponding to the variation rate β (Step S15).

Figure 4:
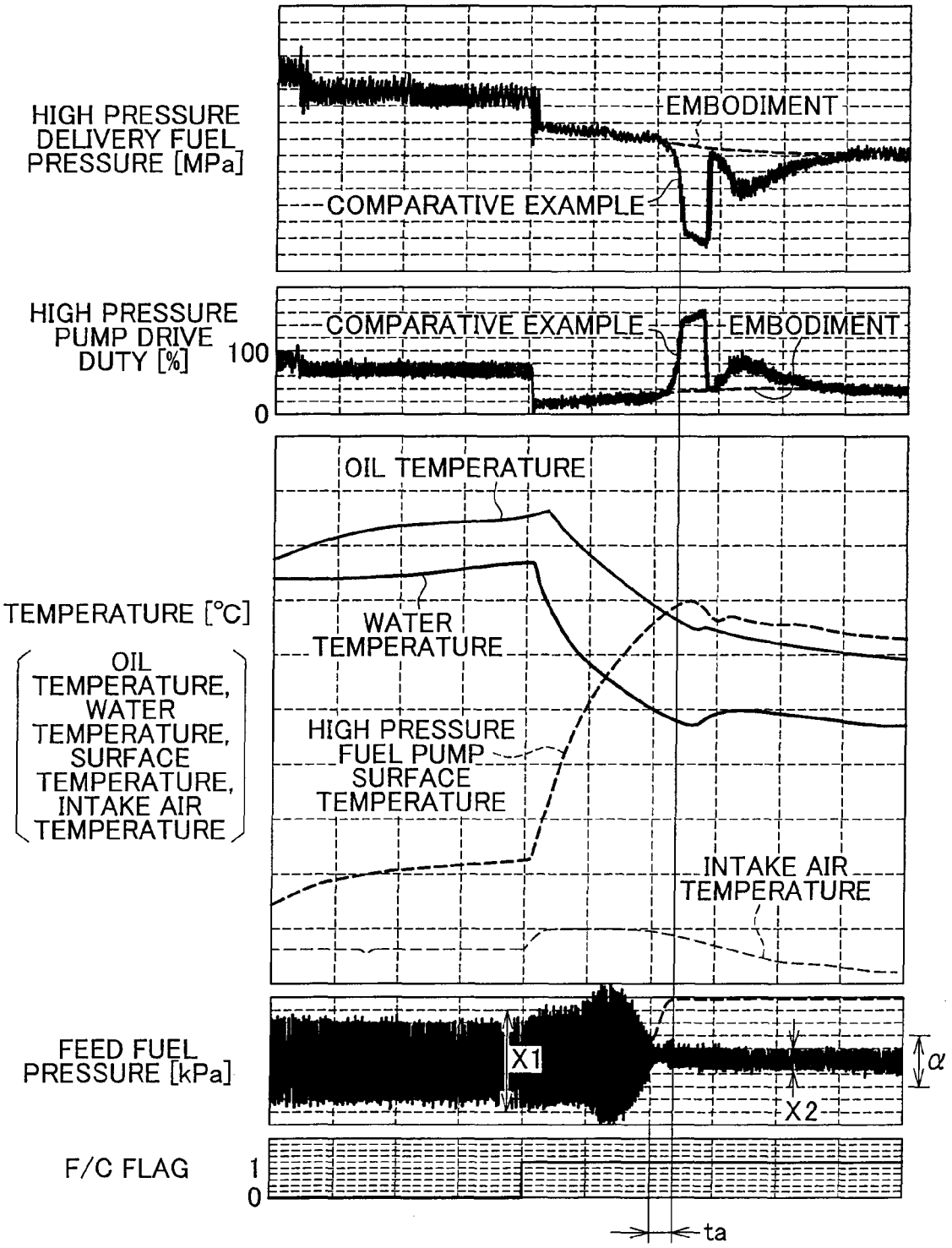
FIG. 4 is a graph illustrating actions of the fuel supply apparatus for an internal combustion engine according to this embodiment of the invention, showing a high pressure delivery fuel pressure during a fuel cut, a drive duty of a high pressure fuel pump, temperatures of respective portions, and a feed fuel pressure and variation in a variation width thereof.

When, at this time, the variation rate X/Xp is smaller than the variation rate β (YES in Step S15), this means that the fuel pressure pulsation width X has attenuated rapidly from a normal variation width X1 (approximately 200 kPa, for example) to a minute variation width X2 (approximately 20 kPa, for example) smaller than the threshold variation width α as shown in FIG. 4. In this case, it is determined that fuel vapor has begun to form in the first fuel pipe 25 or one of the low pressure side delivery pipes 26A, 26B, and a pulsation absorption action (a damping action) generated by the fuel vapor has caused the fuel pressure pulsation width X to decrease rapidly.

Hence, in this case (YES in Step S15), a high feed fuel pressure operating condition in which the feed fuel pressure fed from the feed pump 22 to the high pressure fuel pump 31 is switched to the high pressure side feed fuel pressure is established using a function of the feed fuel pressure switching unit 103 (Step S16). At this time, the feed fuel pressure switching unit 103 establishes an operating condition in which the feed fuel pressure is held at the high pressure side feed fuel pressure by controlling the fuel pressure switching solenoid opening/closing valve 83 of the feed fuel pressure adjustment device 23 to a closed condition so as to cut off the low pressure regulator portion of the feed fuel pressure adjustment device 23 from the first fuel pipe 25, and if necessary by variably controlling the discharge amount of the feed pump 22 to an increased side via the pump driving circuit 84.

When the variation rate X/Xp equals or exceeds the variation rate β (NO in Step S15), on the other hand, a low feed fuel pressure operating condition in which the feed fuel pressure fed from the feed pump 22 to the high pressure fuel pump 31 is switched to the low pressure side feed fuel pressure is established (Step S17). At this time, the feed fuel pressure switching unit 103 establishes an operating condition in which the feed fuel pressure is held at the low pressure side feed fuel pressure by controlling the fuel pressure switching solenoid opening/closing valve 83 of the feed fuel pressure adjustment device 23 to an open condition so as to connect the low pressure regulator portion of the feed fuel pressure adjustment device 23 to the first fuel pipe 25, and if necessary by variably controlling the discharge amount of the feed pump 22 to a reduced side via the pump driving circuit 84.

When the low feed fuel pressure operating condition is established in this manner (when NO is obtained in Step S15 such that the processing advances to Step S17), a calculated value of the current fuel pressure pulsation width X is stored in a predetermined memory area of the RAM (Step S20). The processing then returns to Step S12 in order to input new sensor information, whereupon the processing of Step S12 onward is repeated (Step S12 to S20).

When the fuel pressure pulsation width X attenuates rapidly such that a high feed fuel pressure operation is begun (when YES is obtained in Step S15 such that the processing advances to Step S16), a determination is made as to whether or not a predetermined termination condition for terminating the high feed fuel pressure operation is established (Step S18). Here, the termination condition is established when the pressure detected by the high pressure fuel pressure sensor 69 reaches the preset normal target pressure level enabling the in-cylinder injection (or when the discharge flow rate of the high pressure fuel pump 31 reaches the preset normal flow rate level, or when the engine 10 is operated in a condition where the discharge amount of the in-cylinder injection second injectors 37A, 37B exceeds a fixed amount).

When the termination condition is established, the high feed fuel pressure operation is canceled (Step S19). In other words, the condition in which the pressure of the fuel fed from the feed pump 22 to the high pressure fuel pump 31 is held at the high pressure side feed fuel pressure is canceled, and the feed fuel pressure is returned to the normal low pressure side feed fuel pressure. More specifically, the feed fuel pressure switching unit 103 returns the feed fuel pressure to the low pressure side feed fuel pressure by setting the fuel pressure switching solenoid opening/closing valve 83 of the feed fuel pressure switching device 23 in a non-conductive open condition so as to connect the low pressure regulator portion of the feed fuel pressure adjustment device 23 to the first fuel pipe 25, and if necessary by variably controlling the discharge amount of the feed pump 22 to a reduced side via the pump driving circuit 84.

Next, the calculated value of the current fuel pressure pulsation width X is stored in a predetermined memory area of the RAM (Step S20). The processing then returns to Step S12 in order to input new sensor information, whereupon, the processing of Step S12 onward is repeated (Step S12 to S20).

Hence, in this embodiment, the fuel pressure pulsation width X of the fuel fed from the feed pump 22 to the high pressure fuel pump 31 is detected by the pulsation width detection unit 101, and when fuel pressure variation occurs such that the fuel pressure pulsation width X falls to the threshold variation width α at a rapid reduction speed no lower than a reduction speed corresponding to the variation rate β, the feeding condition determination unit 102 determines that a condition variation causing fuel vapor to form in the fuel fed to the high pressure fuel pump 31 has occurred. Upon reception of this determination result, the feed fuel pressure switching unit 103 switches the pressure of the fuel fed to the high pressure fuel pump 31 to a higher pressure than the normal pressure. Hence, when fuel vapor begins to form in the fuel fed from the feed pump 22 to the low pressure side delivery pipes 26A, 26B and the high pressure fuel pump 31 such that the fuel pressure pulsation width X attenuates rapidly, fuel vapor suppression control for switching the feed fuel pressure fed to the high pressure fuel pump 31 to the high pressure side feed fuel pressure can be executed before the fuel vapor fills the interior of the high pressure fuel pump 31, or in other words within a time to (approximately 20 to 30 seconds, for example) extending from a point at which the fuel pressure pulsation width X attenuates rapidly in FIG. 4 to a point at which a drive duty (the closing drive duty for closing the solenoid spill valve 32) of the high pressure fuel pump 31 subjected to feedback control increases rapidly in accordance with the target fuel pressure. As a result, it is possible to forestall fuel vapor lock in which the fuel in the high pressure fuel pump 31 cannot be pressurized.

Further, in this embodiment, the pulsation width detection unit 101 detects the fuel pressure pulsation width X, and when the fuel pressure pulsation width X falls to the threshold variation width $\alpha$, the feeding condition determination unit 102 determines whether or not the variation rate of the feed fuel pressure at that time indicates rapid attenuation of the feed fuel pressure. Therefore, the determination as to whether or not a condition variation causing fuel vapor to form in the fuel fed to the high pressure fuel pump 31 has occurred can be executed easily, speedily, and accurately while suppressing a processing load of the ECU 50.

Furthermore, the pressure of the fuel fed to the high pressure fuel pump 31 is held at a higher pressure than normal for at least a preset fixed time from the point at which the fuel pressure pulsation width (feed fuel pressure pulsation width) X is detected to have fallen to the threshold variation width $\alpha$ by the pulsation width detection unit 101, and therefore a situation in which the high pressure fuel pump 31 is filled with fuel vapor can be avoided sufficiently.

In particular, the feed fuel pressure switching unit 103 keeps the feed fuel pressure in the high pressure holding condition from the point at which the fuel pressure pulsation width X decreases rapidly after canceling the feed fuel pressure high pressure holding condition when the pressure detected by the high pressure fuel pressure sensor 69 reaches the target pressure level enabling the in-cylinder injection until the pressure detected by the high pressure fuel pressure sensor 69 reaches the target pressure level again. Therefore, the fuel pressure can be modified in an accurate and timely fashion, whereby fuel vapor generation can be suppressed effectively.

Moreover, in this embodiment, when the F/C flag is activated under predetermined operating conditions in the engine 10, indicating establishment of the fuel cut condition in which the fuel supply from the in-cylinder injection second injectors 37A, 37B and the port injection first injectors 27A, 27B is temporarily stopped, the pulsation width detection unit 101 detects the feed fuel pressure pulsation width X of the pressure of the fuel fed to the high pressure fuel pump 31. Hence, the pulsation width detection unit 101 detects the feed fuel pressure pulsation width X of the pressure of the fuel fed to the high pressure fuel pump 31 when the second injectors 37A, 37B have been closed for a comparatively long time such that an internal temperature of the high pressure fuel pump 31 is more likely to rise, and therefore the feed fuel pressure is increased only if necessary. As a result, fuel vapor lock in the high pressure fuel pump 31 can be forestalled reliably. Further, the normal feed fuel pressure can be suppressed to a low pressure, and therefore reductions in fuel efficiency and the lifespan of the feed pump 22 can be prevented.

Furthermore, in this embodiment, the low pressure fuel pressure sensor 68 that detects the feed fuel pressure is mounted on the low pressure side delivery pipe 26B on the side of the second bank 12 on which the high pressure fuel pump 31 is mounted, and therefore the low pressure fuel pressure sensor 68 is disposed in an environment close to a disposal environment of the high pressure fuel pump 31. As a result, the feed fuel pressure can be increased reliably when the internal temperature of the high pressure fuel pump 31 increases.

Note that in the embodiment described above, the feed fuel pressure high pressure holding condition is canceled when the pressure detected by the high pressure fuel pressure sensor 69 reaches the target pressure level enabling the in-cylinder injection. However, the feed fuel pressure high pressure holding condition is maintained until the internal temperature of the high pressure fuel pump 31 has fallen sufficiently after the feed fuel pressure pulsation width X detected by the pulsation width detection unit 101 has fallen to the threshold variation width $\alpha$ likewise in a case where the feed fuel pressure high pressure holding condition is canceled when the discharge flow rate of the high pressure fuel pump 31 reaches the preset normal flow rate level or the engine 10 is operated such that the discharge amount of the in-cylinder injection second injectors 37A, 37B exceeds the fixed amount, and therefore the fuel pressure can be modified in an accurate and timely fashion, whereby fuel vapor generation can be suppressed effectively. Further, in the above embodiment, a condition in which the respective in-cylinder injection second injectors 37A, 37B are closed while the engine 10 is operative corresponds to the fuel cut condition, but a condition in which the in-cylinder injection second injectors 37A, 37B are closed so that fuel is not discharged from the high pressure fuel pump 31 may be applied to a case other than a fuel cut condition. Furthermore, in the above embodiment, the engine 10 is a dual injection type engine, but the invention may also be applied to an internal combustion engine that performs only an in-cylinder injection or an internal combustion engine that performs only a port injection. Moreover, the disposal locations of the low pressure side fuel pressure sensor 68 and the high pressure side fuel pressure sensor 69 are not limited to the furthest downstream positions in the fuel supply pipe, and the sensors may be mounted easily on any of the low pressure side delivery pipes 26A, 26B and the high pressure side delivery pipes 36A, 36B or disposed in other sites.

With the invention described above, it is possible to forestall fuel vapor lock, in which fuel in a high pressure fuel pump cannot be pressurized, by switching a pressure of the fuel fed to the high pressure fuel pump to a high pressure when a pressure variation amount in the fuel supplied from a low pressure fuel pump to the high pressure fuel pump attenuates rapidly due to the formation of fuel vapor in a feeding path of the fuel, i.e. before the fuel vapor fills the high pressure fuel pump. Hence, the invention provides a fuel supply apparatus for an internal combustion engine that can effectively suppress fuel vapor generation at low cost by modifying a fuel pressure in an accurate and timely fashion without producing rotation variation and air-fuel ratio variation in the internal combustion engine due to a reduction in a fuel injection pressure and without causing reductions in a fuel efficiency and a lifespan of a low pressure fuel pump. The invention can therefore be used favorably in all fuel supply apparatuses for an internal combustion engine to suppress fuel vapor generated when fuel from a low pressure fuel pump is pressurized by a high pressure fuel pump and supplied to the internal combustion engine through an injection valve.

The invention claimed is:

1. A fuel supply apparatus for an internal combustion engine, comprising:

a low pressure fuel pump capable of feeding a fuel of the internal combustion engine;

a high pressure fuel pump that pressurizes and discharges the fuel fed from the low pressure fuel pump;

a high pressure fuel injection valve that supplies the fuel pressurized by the high pressure fuel pump to the internal combustion engine selectively; and a controller configured to (i) detect a pulsation width in a pressure of the fuel fed from the low pressure fuel pump to the high pressure fuel pump, and (ii) determine that a condition variation causing fuel vapor to form in the fuel fed from the low pressure fuel pump to the high pressure fuel pump has occurred when the pulsation width detected by the controller falls to a preset threshold pulsation width, wherein a normal pressure of the fuel fed from the low pressure fuel pump to the high pressure fuel pump is a pressure at which the pulsation width exceeds the threshold pulsation width, the controller is further configured to increase the pressure of the fuel fed from the low pressure fuel pump to the high pressure fuel pump to a higher pressure than the normal pressure when the controller determines that the condition variation causing fuel vapor to form in the fuel fed from the low pressure fuel pump to the high pressure fuel pump has occurred, and the controller is further configured to hold the pressure of the fuel fed from the low pressure fuel pump to the high pressure fuel pump at the higher pressure for at least a preset fixed time from a point at which the pulsation width detected by the controller falls to the threshold pulsation width.

2. The fuel supply apparatus for an internal combustion engine according to claim 1, further comprising:

a high pressure side fuel pressure sensor that detects a pressure of the fuel pressurized by the high pressure fuel pump, wherein the controller is further configured to control the high pressure fuel pump based on the pressure detected by the high pressure side fuel pressure sensor so that the pressure of the fuel pressurized by the high pressure fuel pump approaches a target pressure, and the controller is further configured to cancel a high pressure holding condition in which the pressure of the fuel fed from the low pressure fuel pump to the high pressure fuel pump is held at the higher pressure when the pressure detected by the high pressure side fuel pressure sensor reaches a preset target pressure level.

3. The fuel supply apparatus for an internal combustion engine according to claim 1, further comprising:

a high pressure side fuel pressure sensor that detects a pressure of the fuel pressurized by the high pressure fuel pump, wherein the controller is further configured to control the high pressure fuel pump based on the pressure detected by the high pressure side fuel pressure sensor so that the pressure of the fuel pressurized by the high pressure fuel pump approaches a target pressure, and the controller is further configured to cancel a high pressure holding condition in which the pressure of the fuel fed from the low pressure fuel pump to the high pressure fuel pump is held at the higher pressure when a discharge flow rate of the high pressure fuel pump reaches a preset normal flow rate level.

4. The fuel supply apparatus for an internal combustion engine according to claim 2, wherein the target pressure is set in advance in accordance with an operating condition of the internal combustion engine to a pressure enabling an in-cylinder injection.

5. The fuel supply apparatus for an internal combustion engine according to claim 1, wherein the controller is further configured to cancel a high pressure holding condition in which the pressure of the fuel fed from the low pressure fuel pump to the high pressure fuel pump is held at the higher pressure, upon establishment of a condition in which the internal combustion engine is operated in a condition where an open period of the high pressure fuel injection valve exceeds a preset threshold injection period.

6. The fuel supply apparatus for an internal combustion engine according to claim 1, wherein the high pressure fuel injection valve is configured to include a plurality of in-cylinder injection injectors, the number of which corresponds to the number of cylinders in the internal combustion engine, and the controller is further configured to detect the pulsation width in the pressure of the fuel fed from the low pressure fuel pump to the high pressure fuel pump, upon establishment of a condition in which the plurality of in-cylinder injection injectors are respectively closed while the internal combustion engine is operative.

7. The fuel supply apparatus for an internal combustion engine according to claim 6, further comprising a low pressure fuel injection valve that supplies the fuel fed from the low pressure fuel pump to the internal combustion engine selectively, wherein the low pressure fuel injection valve is configured to include a plurality of port injection injectors, the number of which corresponds to the number of cylinders in the internal combustion engine, and the controller is further configured to detect the pulsation width in the pressure of the fuel fed from the low pressure fuel pump to the high pressure fuel pump, upon establishment of a condition in which the plurality of in-cylinder injection injectors and the plurality of port injection injectors are respectively closed while the internal combustion engine is operative.

8. The fuel supply apparatus for an internal combustion engine according to claim 6, wherein the condition in which the plurality of in-cylinder injection injectors are respectively closed while the internal combustion engine is operative corresponds to a fuel cut condition in which a fuel supply from the high pressure fuel injection valve is temporarily stopped while the internal combustion engine is operative.

9. The fuel supply apparatus for an internal combustion engine according to claim 1, further comprising a low pressure fuel injection valve that supplies the fuel fed from the low pressure fuel pump to the internal combustion engine selectively, wherein the low pressure fuel injection valve is configured to include a plurality of port injection injectors, the number of which corresponds to the number of cylinders in the internal combustion engine, the internal combustion engine includes a plurality of banks, each having a plurality of cylinders, the high pressure fuel pump is mounted on a bank on one side, from among the plurality of banks, and the fuel supply apparatus further includes a low pressure side fuel pressure sensor that detects a pressure of the fuel fed from the low pressure fuel pump to a port injection injector mounted on the bank on the one side, from among the plurality of port injection injectors.

10. The fuel supply apparatus for an internal combustion engineaccording to claim 1, wherein the controller is further configured to detect a variation width per predetermined time of the pressure of the fuel fed from the low pressure fuel pump to the high pressure fuel pump, and the controller is further configured to determine that the condition variation causing fuel vapor to form in the fuel fed from the low pressure fuel pump to the high pressure fuel pump has occurred based on a variation rate of the variation width when the variation width of the pressure of the fuel detected by the controller falls to the preset threshold pulsation width.

11. The fuel supply apparatus for an internal combustion engine according to claim 3, wherein the target pressure is set in advance in accordance with an operating condition of the internal combustion engine to a pressure enabling an in-cylinder injection.

* * * * *